United States Patent [19]

Wolff et al.

[11] Patent Number: 4,457,087

[45] Date of Patent: Jul. 3, 1984

[54] STEAM TROUGH MANGLE WITH HEAT RECYCLING APPARATUS

[75] Inventors: Christian Wolff; Gerhard Lippold, both of Karl Marx Stadt, German Democratic Rep.

[73] Assignee: VEB Kombinat Textima, Karl Marx Stadt, German Democratic Rep.

[21] Appl. No.: 354,865

[22] Filed: Mar. 4, 1982

[30] Foreign Application Priority Data

Jul. 20, 1981 [DD] German Democratic Rep. ..... 2319111

[51] Int. Cl.[3] ..... D06F 65/10

[52] U.S. Cl. ..... 38/55; 34/86

[58] Field of Search ..... 34/86, 114; 38/54, 55, 38/49, 1 R, 2, 7, 52, 56, 57

[56] References Cited

U.S. PATENT DOCUMENTS

| | | | |
|---|---|---|---|
| 3,484,966 | 12/1969 | Gruner et al. | 38/55 |
| 3,878,627 | 4/1975 | Mazzolla | 38/56 |
| 4,103,434 | 8/1978 | Walker | 34/114 |

FOREIGN PATENT DOCUMENTS

| | | | |
|---|---|---|---|
| 962486 | 7/1964 | United Kingdom | 38/55 |
| 2719670 | 11/1977 | United Kingdom | 34/86 |
| 2069539 | 8/1981 | United Kingdom | 38/49 |

*Primary Examiner*—Werner H. Schroeder
*Assistant Examiner*—Andrew M. Falik
*Attorney, Agent, or Firm*—Jordan and Hamburg

[57] ABSTRACT

A method for operating a steam trough mangle wherein exhaust air is separated into recirculating air and discharge air with the recirculating air remaining in the air circulation system of the mangle while the discharge air is subjected to a heat transfer process. The recirculating air and fresh air heated by the discharge air are both fed to a trough area of the mangle. The mangle or hot bed ironer in which this method may be carried out includes an air discharging apparatus inside a mangle area that is almost completely enclosed which is connected with a suctioning apparatus for exhausting air and also with the first flow chamber of associated heat transfer means. The heat transfer means has a second flow chamber connected to the suctioning apparatus.

7 Claims, 1 Drawing Figure

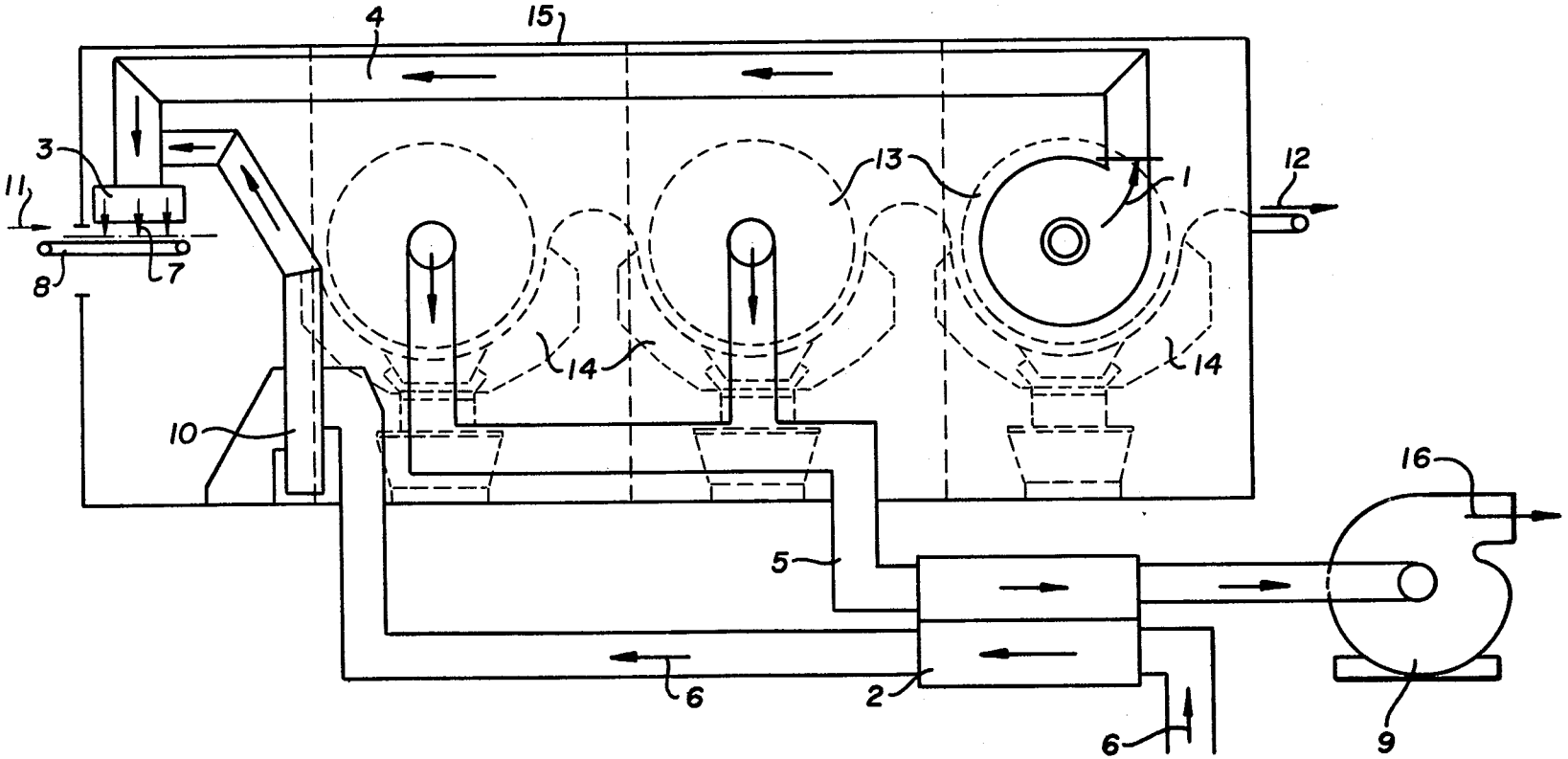
1
2
3
4
5
6
7
8
9
10
11
12
13
14
15
16

STEAM TROUGH MANGLE WITH HEAT RECYCLING APPARATUS

The invention relates to a steam trough mangle for drying and smoothing damp laundry pieces, in which suctioning of the exhaust air enriched with water vapor from the interior of the mangle cylinder occurs.

It has been known to suction the water-steam-air mixture formed in the operating areas between the mangle cylinders and the mangle troughs on ironing of laundry pieces as exhaust air. For this purpose, the mangle cylinder, in most cases, has a perforated jacket surface and a hollow bearing pin which is connected to a suction apparatus.

This exhaust air contains a substantial amount of heat, which has to be continuously generated by the heating system of the steam trough mangle.

For this reason, a steam trough mangle is already known in which at least a portion of such waste heat is reutilized (DE-PS No. 468 074). In this mangle, the suction line that is connected to the mangle cylinder leads through a ventilator to a passage of a heat transfer means adapted to transfer the heat from one stream to another one. For this purpose, the heat transfer means has a second passage, through which, through another ventilator, the air inspired from the surroundings of the steam trough mangle is forced. The fresh air that has been heated in this manner is guided to two boxes that are arranged in the front and in the back of the mangle trough, having perforation points in the form of a sieve for the outlet of the fresh air. The fresh air transfers its heat in the area of these boxes to the laundry passing in front of it, pre-drying or re-drying the same.

The disadvantage in such an arrangement, to begin with, is that the heated fresh air, after streaming onto the laundry, escapes to the foundation area of the steam trough mangle, resulting in great inconvenience to the staff servicing the same.

In addition, a substantial amount of heat is lost to the steam trough mangle system.

It is the object of the invention to reduce energy losses of the steam trough mangle while preventing inconveniences to the servicing personnel.

The invention has the object of creating a method for operating a steam trough mangle which allows for the greatest re-utilization of the heat contained in the exhaust air as well as making available a steam trough mangle suitable for such purpose.

SUMMARY OF THE INVENTION

The separation of the exhaust air according to this invention into recirculating air and discharge air has the advantage that a substantial portion of the amount of heat contained in the exhaust air will also remain directly in the steam trough mangle with the recirculated air. Losses, which necessarily originate on the transmission of heat from one air stream to another one in view of the fact that an air-air heat transfer is relatively unfavorable in relation to a heat transfer between other media, can thus be prevented.

At the same time, however, the amount of heat contained in the discharge fresh air still is great enough to preheat the inlet fresh air to an extent such that it will, together with the recirculated air, have a high drying potential.

BRIEF DESCRIPTION OF THE DRAWING

The invention will now be described in more detail by means of an example of an embodiment. The drawing shows a schematic side view of a steam trough mangle according to the present invention.

DETAILED DESCRIPTION OF A PREFERRED EMBODIMENT

Such a steam trough mangle has as an essential operating element at least one mangle cylinder 13 which is rotatably mounted. This mangle cylinder, in turn, is at least partially surrounded on its jacket side by at least one mangle trough 14 (preferably at a center angle between 120° and 180°). In the present example, exactly one mangle cylinder 13 and a mangle trough 14 form a mangle unit 13; 14. As represented in the drawing, a steam trough mangle may comprise several mangle units 13; 14 arranged close to each other in a row.

The mangle troughs 14 are heated. For this purpose, they have heating elements through which, in most cases, a flowable heat carrier medium flows. This may, for example, be superheated steam, hot water or heat carrier oil.

A feed unit of a known type has been arranged in front of the first mangle unit 13; 14.

The mangle cylinders 13 are formed as hollow cylinders and have a perforated jacket surface. In a similar manner, one bearing pin of each mangle cylinder 13 is hollow. This makes it possible to suction the exhaust air that has been enriched by the water vapor formed on the ironing of laundry pieces 11 from the mangle cylinder 13 in a sufficiently known manner.

The method of this invention now provides separation of the exhaust air suctioned from the mangle cylinder 13 into recirculating air 4 and discharge air 5. The recirculating air 4 is to remain herein within an air circulation circuit of the steam trough mangle, while the discharge air 5 is fed, in a known manner, to a heat transfer process where it transmits a portion of its heat to fresh air 6 and heats the same, which has been absorbed from the surroundings of the steam trough mangle.

According to this invention, this heated fresh air 6 is fed together with recirculating air 4, to a mangle area of the steam trough mangle. This mangle area is bounded by a compartment 15 almost totally closed on all sides and which only has openings for passage of laundry pieces 11 entering the steam trough mangle and of the exiting laundry pieces 12.

When several mangle units 13; 14 are provided, as is the case in the present example, the method of this invention can be carried out in a manner such that the exhaust air of one mangle unit 13; 14 will remain as recirculating air in the air circulation system, while the exhaust air of the remaining mangle units 13; 14 is transferred as discharge air 5 to the heat transfer process.

In accordance with the present invention, the recirculating air 4 and the heated fresh air 6 can be especially advantageously blown onto the laundry pieces 11 spread out along the surface of an area in front of the first mangle unit 13; 14.

A steam trough mangle that can be operated in accordance with the present invention has already been described in a broad outline. In addition, reference is made to a steam trough mangle, which makes the execution of this method possible in a specific manner for steam trough mangles comprising several mangle units 13; 14.

For this purpose, the two first mangle units 13; 14 are connected to a discharge air ventilator 9 through the flow chamber of a heat transfer means 2, while the third and last mangle unit 13; 14, in the throughput direction of the steam trough mangles, is provided with a separate recirculating air ventilator 1, the delivery line of which leads directly to an air distributing box 3. This box is arranged in the area of feed unit 8.

A second flow chamber of the heat transfer means 2 is connected with a fresh air ventilator 10. Its delivery line also leads to the air distributing box 3.

The mode of operation of the steam trough mangle of this invention is as follows:

The exhaust air suctioned from the first two mangle units 13; 14 flows through a flow chamber of heat transfer means 2 under the action of the discharge air ventilator 9. Fresh air 6 is suctioned in from the surroundings of the steam trough mangle by means of the fresh air ventilator 10 through the second flow chamber of the heat transfer means 2. The discharge air 5 herein heats up the fresh air 6, and passes from the steam trough mangle in the form of cooled discharge air 16.

The fresh air 6 that has been heated is conveyed to the air distributing box 3 through the fresh air ventilator 10.

The recirculating air ventilator 1, in turn, conveys the exhaust air suctioned from the third mangle unit 13; 14, in the form of recirculating air to the air distributing box 3.

The recirculating air 4 and the fresh air 6 combine into air supply 7 which is blown onto the laundry pieces, predrying them before they reach the first mangle unit 13; 14.

At the same time, only heated air is supplied to the mangle area bounded by compartment 15 so that the mangle troughs 14 do not have to deliver additional energy for heating the air contained in the mangle area.

The air circulation system for the recirculating air 4 is closed in that the air supply 7 is again suctioned through the perforated jacket surface of the mangle cylinders 13, into the interior thereof, to be enriched with water vapor coming from the mangle areas between the mangle cylinders 13 and the mangle troughs 14.

The invention can also be attained by having the waste air of all provided mangle units 13; 14 suctioned by a common waste air ventilator and separated into recirculating air and discharge air by means of a branched exhaust air line.

We claim:

1. A steam trough mangle comprising (A) a mangle cylinder with a perforated jacket surface, (B) a mangle trough at least partially enclosing said mangle cylinder around its jacket surface, (C) an outer frame structure enclosing said mangle cylinder and trough, (D) a device for suctioning exhaust air from the interior of said mangle cylinder, said exhaust air enriched with vapor from ironing of laundry by said mangle cylinder and trough, (E) a device for suctioning fresh air from outside said frame structure, (F) means for transferring heat from one stream of air to another stream of air comprising two flow chambers one of which is connected with said fresh air suctioning device, the other of which is connected with said exhaust air suctioning device, and (G) an air distributing device connected with the flow chamber of said heat transfer means that is connected with said fresh air suctioning device, and also connected with said exhaust air suctioning device, in which said exhaust air is separated into recirculating air and discharge air, said discharge air being fed to the flow chamber of said heat transfer means that is connected with said exhaust air suctioning device and said recirculating air remaining in circulation within said steam trough mangle.

2. A method for operating a steam trough mangle, comprising the steps of (A) enriching exhaust air from a substantially enclosed mangle cylinder and trough with vapor generated by ironing of laundry by said mangle cylinder and trough, (B) separating said exhaust air into recirculating air and discharge air, (C) directing said discharge air through one chamber of a heat transfer means and then away from said mangle, (D) directing fresh air through another chamber of said heat transfer means to heat said fresh air with said exhaust air, (E) mixing said fresh air with said recirculating air, and (F) recirculating said mixture of fresh air and recirculating air through said mangle.

3. A steam trough mangle comprising (A) a plurality of mangle cylinders each having a perforated jacket surface;

(B) a plurality of mangle troughs at least partially enclosing said mangle cylinders around their jacket surfaces;

(C) an outer frame structure substantially enclosing said mangle cylinders and troughs;

(D) a plurality of devices for suctioning exhaust air from the interior of said mangle cylinders, said exhaust air enriched with vapor from ironing of laundry by said mangle cylinders and troughs;

(E) a device for suctioning fresh air from outside said frame structure;

(F) means for transferring heat from one stream of air to another stream of air comprising two flow chambers, one of which is connected with said fresh air suctioning device, the other of which is connected with said exhaust air suctioning device; and (G) an air distributing device connected with the flow chamber of said heat transfer means that is connected with said fresh air suctioning device, and also connected with said exhaust air suctioning device, in which said exhaust air is separated into recirculating air and discharge air, said discharge air being fed to the flow chamber of said heat transfer means that is connected with said exhaust air suctioning device, and said recirculating air remaining in circulation within said stream trough mangle.

4. The mangle of claim 3, in which said fresh air and recirculating air are mixed directly upstream of said air distributing device.

5. The mangle of claim 4, in which the air distributing device is in the form of a nozzle to blow air in laundry to be ironed in order to pre-dry said laundry.

6. A method for operating a steam trough mangle, comprising the steps of (A) enriching exhaust air from a plurality of substantially enclosed mangle cylinders and troughs with vapor generated by ironing of laundry by said mangles and troughs;

(B) separating said exhaust air into recirculating air and discharge air, exhaust air exiting from at least one of said mangle cylinders and troughs constituting said recirculating air being mixed with fresh air and then recirculated through said mangles, exhaust air exiting from at least one other mangle cylinder and trough constituting discharge air and being directed to said heat transfer means;

(C) directing said discharge air through one chamber of a heat transfer means and then away from said mangles;

(D) directing said fresh air through another chamber of said heat transfer means to heat said fresh air with said exhaust air;

(E) mixing said fresh air with said recirculating air;

(F) recirculating said mixture of fresh air and recirculating air through said mangles.

7. The method of claim 6, wherein said recirculating air and said fresh air, after being mixed, are blown across laundry to be ironed to pre-dry said laundry.

* * * * *